US009400109B2

(12) United States Patent
Taimura

(10) Patent No.: US 9,400,109 B2
(45) Date of Patent: Jul. 26, 2016

(54) HEATER AND GLOW PLUG INCLUDING THE SAME

(75) Inventor: Kotaro Taimura, Kirishima (JP)
(73) Assignee: Kyocera Corporation, Kyoto (JP)

( * ) Notice: Subject to any disclaimer, the term of this patent is extended or adjusted under 35 U.S.C. 154(b) by 153 days.
(21) Appl. No.: 14/342,317
(22) PCT Filed: Aug. 27, 2012
(86) PCT No.: PCT/JP2012/071591
§ 371 (c)(1), (2), (4) Date: Feb. 28, 2014
(87) PCT Pub. No.: WO2013/031728
PCT Pub. Date: Mar. 7, 2013
(65) Prior Publication Data
US 2014/0224783 A1 Aug. 14, 2014
(30) Foreign Application Priority Data
Aug. 29, 2011 (JP) ..... 2011-186180
(51) Int. Cl.
*F23Q 7/22* (2006.01)
*H05B 3/48* (2006.01)
*F23Q 7/00* (2006.01)
(52) U.S. Cl.
CPC *F23Q 7/22* (2013.01); *F23Q 7/001* (2013.01); *H05B 3/48* (2013.01); *H05B 2203/027* (2013.01)
(58) Field of Classification Search
CPC combination set(s) only.
See application file for complete search history.

(56) References Cited

U.S. PATENT DOCUMENTS 5,362,944 A * 11/1994 Hatanaka ..... H05B 3/18 219/270
5,883,360 A * 3/1999 Tatematsu ..... F23Q 7/001 219/267
5,948,306 A * 9/1999 Konishi ..... F27D 99/006 219/270
6,013,898 A * 1/2000 Mizuno ..... F23Q 7/001 123/145 A
6,025,579 A * 2/2000 Tanaka ..... C04B 35/565 219/270
6,049,065 A * 4/2000 Konishi ..... F23Q 7/001 219/270
6,111,223 A * 8/2000 Tatematsu ..... F23Q 7/001 123/145 A
6,204,481 B1 * 3/2001 Ito ..... H05B 3/14 123/145 A
2002/0162830 A1 * 11/2002 Taniguchi ..... F23Q 7/001 219/270
2002/0162831 A1 * 11/2002 Taniguchi ..... F23Q 7/001 219/270
2006/0011602 A1 * 1/2006 Konishi ..... F23Q 7/00 219/270
2009/0008383 A1 * 1/2009 Kurono ..... F23Q 7/001 219/553
2009/0320782 A1 * 12/2009 Hiura ..... F23Q 7/00 123/145 A
2011/0068091 A1 3/2011 Hiura

FOREIGN PATENT DOCUMENTS

JP 2006049279 A 2/2006
JP 2001280640 A 10/2011
WO 2009096477 A1 8/2009

OTHER PUBLICATIONS

International Search Report, PCT/JP2012/071591, Sep. 18, 2012, 1pg.

* cited by examiner

*Primary Examiner* — Dana Ross
*Assistant Examiner* — Renee L Larose
(74) *Attorney, Agent, or Firm* — Volpe and Koenig, P.C.

(57) ABSTRACT

A heater of the present invention includes an insulating base, a resistor embedded in the insulating base, a lead embedded in the insulating base. One end of the lead is joined to the resistor, and the other end is led out as a terminal portion on the surface of the insulating base. The lead in longitudinal section has at least two bent portions. The bent portions in cross-section each have an aspect ratio larger than the aspect ratio of the terminal portion.

6 Claims, 3 Drawing Sheets

HEATER AND GLOW PLUG INCLUDING THE SAME

FIELD OF INVENTION

The present invention relates to a heater used as, for example, an ignition or flame detection heater for in-vehicle heating apparatuses, an ignition heater for burning appliances including an oil fan heater, a glow plug heater of an automobile engine, a heater for sensors including an oxygen sensor, or a heater for heating measuring instruments, and to a glow plug including the same.

BACKGROUND

For example, a glow plug heater of an automobile engine has been known which includes an insulating base, a resistor embedded in the insulating base, and a lead embedded in the insulating base. The lead is joined to the resistor at one end thereof and the other end is led out as a terminal portion on the surface of the insulating base.

More specifically, a known glow plug heater has the structure in which a lead for an anode has at least two bent portions in longitudinal section, and is led out as a terminal portion disposed at, for example, the back end of the insulating base (see, for example, PTL 1). The lead is led out as the terminal portion, keeping the diameter thereof at the two bent portions.

CITATION LIST

Patent Literature

[PTL 1] Japanese Unexamined Patent Application Publication No.

SUMMARY

Technical Problem

In recent years, a heater capable of more rapid heating has been desired, and accordingly, a need has occurred for increasing the electric power (inrush power) supplied through the terminal portion so that a large current is applied to the resistor at the start (at the start of the engine).

However, if you try to increase the inrush power of the heater, the load of the inrush power is concentrated particularly on the outer side of the curve of the bent portion of the lead, and this load-concentrated portion is locally heated to expand thermally. This undesirably causes a micro-crack in the interface between the lead and the insulating base.

The present invention is proposed in view of the above issue, and an object of the invention is to provide a highly reliable, durable heater in which micro-cracks caused by stress concentration resulting from local expansion are suppressed even when a large current flows through the bent portion of the lead, for example, for rapid heating, and to provide a glow plug including the heater.

Solution to Problem

A heater of the present invention includes an insulating base, a resistor embedded in the insulating base, a lead embedded in the insulating base. One end of the lead is joined to the resistor, and the other end is led out as a terminal portion on a surface of the insulating base. The lead in longitudinal section has at least two bent portions. The bent portions in cross-section each have an aspect ratio larger than the aspect ratio of the terminal portion.

A glow plug of the present invention includes a heater having the above-described structure, and a metallic holding member electrically joined to the terminal portion and holding the heater.

Advantageous Effects of Invention

According to the heater of the present invention, the load of inrush power placed on the two bent portions is dispersed from the outer sides of the curves of the bent portions, and micro-cracks in the interface between the lead and the insulating base are thereby suppressed.

DETAILED DESCRIPTION OF THE PREFERRED EMBODIMENTS

An embodiment of the heater of the present invention will now be described in detail with reference to the drawings.

Figure 1:
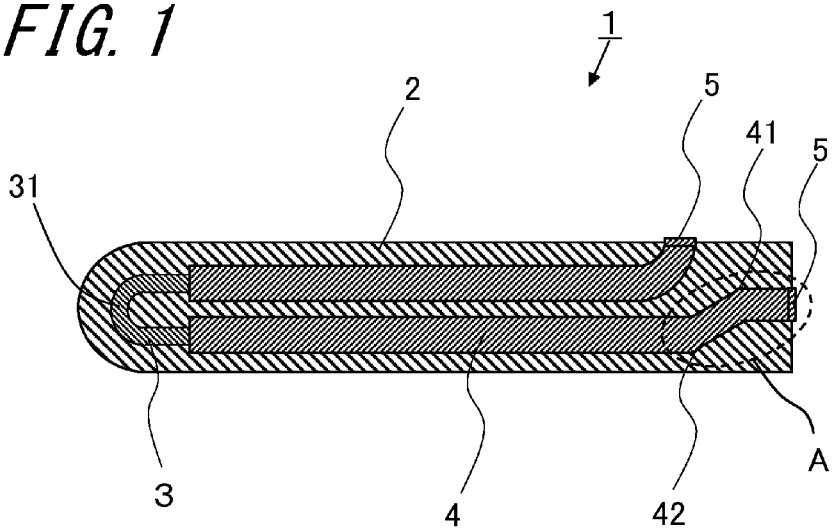
FIG. 1 is a longitudinal sectional view of an embodiment of the heater of the present invention.
Figure 2:
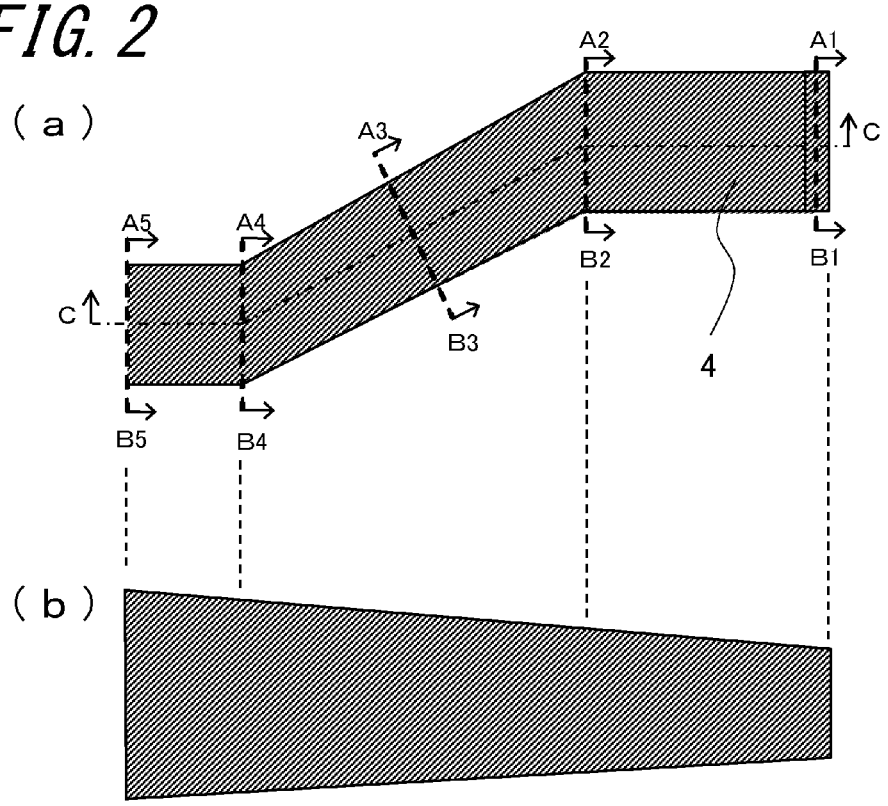
FIG. 2 (*a*) is an enlarged view of region A including a bent portion of a lead shown in FIG. 1, and (*b*) is a sectional view taken along line C-C shown in (*a*).
Figure 3:
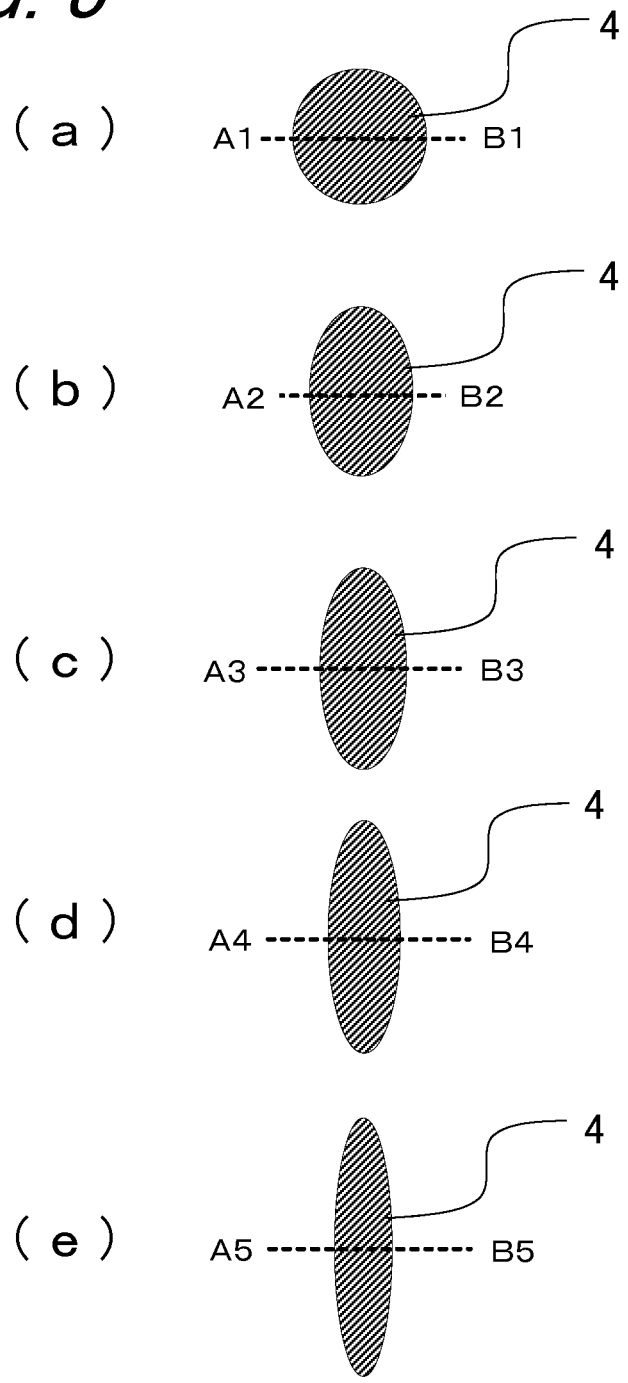
FIG. 3 (*a*) is a sectional view taken along line A1-B1 shown in FIG. 2; (*b*) is a sectional view taken along line A2-B2 shown in FIG. 2; (*c*) is a sectional view taken along line A3-B3 shown in FIG. 2; (*d*) is a sectional view taken along line A4-B4 shown in FIG. 2; and (*e*) is a sectional view taken along line A5-B5 shown in FIG. 2.

FIG. 1 is a longitudinal sectional view of an embodiment of the heater of the present invention. FIG. 2(*a*) is an enlarged view of region A including a bent portion shown in FIG. 1, and FIG. 2(*b*) is a sectional view taken along line C-C shown in (a). FIG. 3(*a*) is a sectional view taken along line A1-B1 shown in FIG. 2; FIG. 3(*b*) is a sectional view taken along line A2-B2 shown in FIG. 2; FIG. 3(*c*) is a sectional view taken along line A3-B3 shown in FIG. 2; FIG. 3(*d*) is a sectional view taken along line A4-B4 shown in FIG. 2; and FIG. 3(*e*) is a sectional view taken along line A5-B5 shown in FIG. 2.

The heater 1 of the present embodiment includes an insulating base 2, a resistor 3 embedded in the insulating base 2, a lead 4 embedded in the insulating base 2. One end of the lead 4 is joined to the resistor 3, and the other end is led out as a terminal portion 5 on a surface of the insulating base 2. The lead 4 in longitudinal section has at least two bent portions 41 and 42. The bent portions 41 and 42 in cross-section each have an aspect ratio larger than the aspect ratio of the terminal portion 5.

The insulating base 2 of the heater 1 of the present embodiment has been formed in, for example, a rod-like shape. In the insulating base 2, the resistor 3 and the lead 4 are embedded. Preferably, the insulating base 2 is made of a ceramic. Consequently, the heater 1 can be highly reliable in rapid heating. More specifically, examples of the ceramic include oxide ceramics, nitride ceramics, carbide ceramics, and other electrically insulating ceramics. Preferably, the insulating base 2 is made of a silicon nitride-based ceramic. This is because silicon nitride, which is the main constituent of silicon nitride-based ceramics, is superior in strength, toughness, insulation, and heat resistance. For forming the insulating base 2 made of a silicon nitride-based ceramic, for example, 3% to 12% by mass of a rare-earth metal oxide as a sintering agent, such as $Y_2O_3$, $Yb_2O_3$, or $Er_2O_3$, 0.5% to 3% by mass of $Al_2O_3$, and $SiO_2$ are mixed to 100% by mass of the main constituent silicon nitride. The amount of $SiO_2$ added is such that the $SiO_2$ content in the sintered compact can be 1.5% to 5% by mass. The mixture is formed into a predetermined shape and then subjected to hot plate sintering at 1650 to 1780° C. The insulating base 2 has a length of, for example, 20 to 50 mm and a diameter of, for example, 3 to 5 mm.

If the insulating base 2 is made of a silicon nitride-based ceramic, it is preferable to add MoSi2, $WSi_2$, or the like and disperse it in the ceramic. These materials can bring the thermal expansion coefficient of the base matrix or silicon nitride-based ceramic close to the thermal expansion coefficient of the resistor 3, thereby enhancing the durability of the heater 1.

For example, in the embodiment shown in FIG. 1, the resistor 3 embedded in the insulating base 2 has a longitudinal section in a turn-back shape. The midpoint of the turning back and its vicinity act as a heat-generating portion 31 at which heat is most generated. The resistor 3 is embedded by the tip of the insulating base 2 and has a dimension of, for example, 2 to 10 mm from the tip thereof (around the midpoint of the turn-back shape) to the ends thereof (ends joined to leads). The cross section of the resistor 3 may be circular, oval, or rectangular and can be in any shape. Typically, the resistor 3 has a smaller section than the lead 4 described below.

The resistor 3 may be made of a material mainly containing a carbide, a nitride or a silicide of W, Mo, Ti or the like. If the insulating base 2 is made of a silicon nitride-based ceramic, tungsten carbide (WC) is most suitable of those materials as the material of the resistor 3 because it has a small difference in thermal expansion coefficient from the insulating base 2, and has a high heat resistance and a low specific resistance. If the insulating base 2 is made of a silicon nitride-based ceramic, it is more preferable that the resistor 3 contain mainly WC, which is an inorganic electroconductive material, and, in addition, 20% by mass or more of silicon nitride. The resistor 3 in the insulating base 2 of, for example, a silicon nitride-based ceramic is in general under the condition where a stress is placed thereon because the electroconductive material of the resistor 3 has a larger thermal expansion coefficient than silicon nitride. However, by adding silicon nitride to the resistor 3, the thermal expansion coefficient is brought close to that of the insulating base 2 to reduce the stress resulting from the difference in thermal expansion coefficient produced during the heating or cooling of the heater 1. Also, if the silicon nitride content in the resistor 3 is 40% by mass or less, the resistance of the resistor 3 can be relatively low and stable. The silicon nitride content in the resistor 3 is preferably 20% by mass to 40% by mass. More preferably, the silicon nitride content is 25% by mass to 35% by mass. As an alternative to silicon nitride, 4% by mass to 12% by mass of boron nitride may be added as a similar additive of the resistor 3.

The lead 4 embedded in the resistor 2 is joined to the resistor 3 at one end thereof, and the other end is led out as a terminal portion 5 on the surface of the insulating base. In the embodiment shown in FIG. 1, the ends of the resistor 3 turned back from one end to the other are joined to respective leads 4. One of the leads 4 is joined to one end of the resistor 3 at one end thereof, and the other end of the lead is led out as a terminal portion 5 on the back end of the insulating base 2. The other lead 4 is joined to the other end of the resistor 3 at one end thereof, and the other end of the lead is led out as a terminal portion 5 near the back end of the insulating base 2 on the side surface thereof.

The leads 4 are made of the same material as the resistor 3, and their resistance per unit length is set lower than the resistor 3 by, for example, increasing the sectional area relative to that of the resistor 3, or by reducing the content of the insulating base 2 material relative to the that in resistor 3. In particular, WC is suitable as the material of the lead 4 because WC has a small difference in thermal expansion coefficient from the insulating base 2, and has a high heat resistance and a low specific resistance. Preferably, the lead 4 mainly contains an inorganic electroconductive material WC, and further contains silicon nitride with a content of 15% by mass or more. As the silicon nitride content is increased, the thermal expansion coefficient of the lead 4 comes close to that of the silicon nitride of the insulating base 2. Also, the lead 4 containing silicon nitride with a content of 40% by mass or less has a stable, low resistance. The silicon nitride content is preferably 15% by mass to 40% by mass. More preferably, the silicon nitride content is 20% by mass to 35% by mass.

One of the leads 4 in longitudinal section has at least two bent portions 41 and 42. The bent portions 41 and 42 in cross section each have an aspect ratio larger than the aspect ratio of the terminal portion 5.

The lead 4 described here refers to the lead 4 shown in FIG. 1 that is joined to the resistor 3 at one end and led out as the terminal portion 5 disposed on the back end of the insulating base 2, and the bent portions 41 and 42 shown in FIGS. 1 and 2 correspond to the portions shown in FIG. 3 as the B2-A2 cross section and the B4-A4 cross section, respectively. For the aspect ratio (ratio of length to width), the lengthwise direction is a direction perpendicular to a plane (including the central axis of the bent portions 41 and 42) parallel to the direction in which the bent portions 41 and 42 are bent (direction perpendicular to the plane of FIG. 1).

The terminal portion 5 refers to the end of the lead 4 not joined to the resistor, and may be formed of the same material as the other portion of the lead 4 in one body or a different body, or may be formed of a different material.

FIGS. 3(*a*) to 3(*e*) show oval sections whose longer axes are perpendicular to a plane (including the central axis of the bent portions 41 and 42) parallel to the direction in which the bent portions 41 and 42 are bent (direction perpendicular to the plane of FIG. 1). In the figures, the aspect ratios (ratio of length to width) of the sections are increased gradually in the direction in which the distance from the terminal portion 5 increases. More specifically, the longer axis of the A2-B2 cross section of the bent portion 41 shown in FIG. 3(*b*) is longer than that of the A1-B1 cross section of the terminal portion 5 shown in FIG. 3(*a*). The longer axis of the A3-B3 cross section, shown in FIG. 3(*c*), closer to the resistor 3 is longer than that of the A2-B2 cross section of the bent portion 41 shown in FIG. 3(*b*). The longer axis of the A4-B4 cross section, shown in FIG. 3(*d*), of the bent portion 42 closer to the resistor 3 is longer than that of the A3-B3 cross section shown in FIG. 3(*c*). The longer axis of the A5-B5 cross section, shown in FIG. 3(*e*), still closer to the resistor 3 is longer than that of the A4-B4 cross section of the bent portion 42 shown in FIG. 3(*d*).

The load of inrush power from the terminal portion 5 tends to increase at the outer side of the bends of the bent portions 41 and 42 in section, that is, at the A2 side shown in FIGS. 2 and 3(*b*) and the B4 side shown in FIGS. 2 and 3(*d*). When an object has a circular cross section, in general, the load of inrush power placed on the object in a diameter direction disperses substantially equally at all angles of 360°. In the case where the cross section has a longer axis and a shorter axis, however, the load of inrush power tends to be placed on the vicinity of the outer periphery in the longer axis direction. Accordingly, by forming a structure in which the cross section of the bent portion 41 has a larger aspect ratio than the cross section of the terminal portion 5 while the cross section of the bent portion 42 has a larger aspect ratio than the cross section of the terminal portion 5, the load of inrush power on the two bent portions 41 and 42 can be dispersed from the outer sides of the bends to other part. More specifically, micro-cracks that may be formed in the bent portions 41 and 42 can be suppressed by determining the positions of the longer axis so that inrush power can be dispersed from the outer side of the bends (A2 side in FIGS. 3(*b*) and B4 side in FIG. 3(*d*)), and thus by allowing the load of inrush power to disperse from the outer side of the bends of the bent portions 41 and 42 in section to the vicinities of the portions of the periphery in the longer axis direction.

In this instance, when the cross sections of the bent portions 41 and 42 has aspect ratios of, for example, 1.2 to 5.0, the load of inrush power can be dispersed effectively without allowing excess stress to concentrate in the longer axis direction.

Preferably, the bent portions 41 and 42 have oval cross sections. Since oval sections do not have corners and therefore allow stress to disperse easily, the occurrence of micro-cracks can be further suppressed.

In the embodiment shown in FIG. 3, the longer axis is perpendicular to a plane (including the central axis of the bent portions 41 and 42) parallel to the direction in which the bent portions 41 and 42 are bent (direction perpendicular to the plane of FIG. 1). However, the longer axis may be tilted.

Preferably, the aspect ratios of the bent portions 41 and 42 in cross section are gradually increased in the direction from the terminal portion 5 toward the resistor 3, as shown in FIG. 2(*b*). This form enables the load of inrush power to disperse from the first bent portion 41 from the terminal portion 5 and to further disperse from the second bent portion 42, which has a larger aspect ratio, thus suppressing the occurrence of micro-cracks. In addition, it is preferable to gradually increase the aspect ratio in cross section of the portion between the bent portions 41 and 42 in the direction from the terminal portion 5 toward the resistor 3. This form does not have a sudden change in shape and accordingly can suppress the concentration of the lead of inrush power. Also, the form as shown in FIG. 2(*b*), in which the aspect ratios of the portion between the terminal portion 5 and the bent portion 41 and the portion from the bent portion 42 toward the tip, in addition to the bent portions 41 and 42, are gradually varied, is effective in suppressing the concentration of the load of inrush power.

Furthermore, it is preferable that the cross sections of the bent portions 41 and 42 have the same area. Since this form does not have any portion on which load is concentrated in a stationary state, the occurrence of micro-cracks can be further suppressed.

The cross sections may have any shape without being limited to the shapes shown in FIGS. 2 and 3. For example, the shape may be rectangular, rhombic, triangular, hexagonal, octagonal, or any other simple form from the viewpoint of easy formation. Even if the cross sections have these shapes, the bent portions 41 and 42 can be provided with a shape on which load is likely to concentrate at a position other than the position around the middle of the outer sides of the bent portions 41 and 42, and thus the load can be dispersed. For a polygonal cross section as above, load can be excessively concentrated on the corners of the polygonal shape, or the corners are likely to be a point from which a crack occurs in the insulating base 2. Therefore, the corners are preferably rounded. In this point of view, an oval shape having no corners is preferred.

Figure 4:
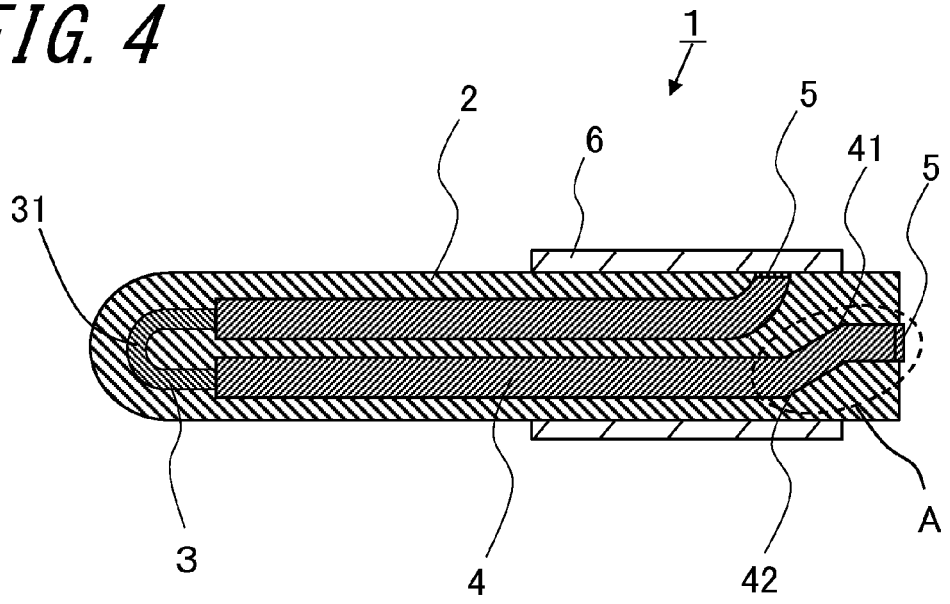
FIG. 4 is a longitudinal sectional view of an embodiment of the glow plug of the present invention.

The heater 1 described above can be used for a glow plug. More specifically, a glow plug of the present invention includes the heater 1, and a metallic holding member 6 (metallic sheath) electrically joined to the terminal portions 5 of the leads 4 of the heater 1 and holding the heater 1, as shown in FIG. 4. The metallic holding member 6 is a tube made of, for example Ni, Fe, or the line, and having a thickness of 0.3 to 1.0 mm. Since this structure does not easily allow micro-cracks to occur in the bent portions 41 and 42 of the heater 1, the glow plug can be used for a long time.

An exemplary process for manufacturing the heater 1 of the present embodiment will now be described.

The heater 1 of the present embodiment may be produced by, for example, injection molding using metallic molds having the shapes corresponding to the resistor 3, the leads 4 and the insulating base 2.

First, an electroconductive paste containing an electroconductive ceramic powder and a resin binder is prepared for forming the resistor 3 and the lead 4, and a ceramic paste containing an insulating ceramic powder and a resin binder is prepared for forming the insulating base 2.

Subsequently, a compact (compact a) having a predetermined pattern of the electroconductive paste that will be used as the resistor 3 is formed by injection molding or the like using the electroconductive paste. Then, a compact (compact b) having a predetermined pattern of the electroconductive paste that will be used as the leads 4 is formed by introducing the electroconductive paste into the metallic mold with the compact a kept therein. Thus a state is established in which the compact a and the compact b joined to the compact a are held in the metallic mold.

Subsequently, after a part of the metallic mold, in which compact a and the compact b are held, is replaced with a mold for forming the insulating base 2, the ceramic paste for forming the insulating base 2 is introduced to the mold. Thus a compact (compact d) of the heater 1 is prepared in which the compact a and the compact b are covered with the compact (compact c) of the ceramic paste.

Subsequently, the resulting compact d is sintered at a temperature of 1650° C. to 1780° C. and a pressure of 30 MPa to 50 MPa to yield the heater 1. The sintering is preferably performed in an atmosphere of hydrogen gas and a non-oxidizing gas.

EXAMPLE

A heater of the Example of the present invention was prepared as described below.

First, an electroconductive paste containing 50% by mass of tungsten carbide (WC) powder, 35% by mass of silicon nitride ($Si_3N_4$) powder, and 15% by mass of a resin binder was injected into a metallic mold to form a compact a for a resistor having the shape shown in FIG. 1.

Subsequently, the same electroconductive paste for forming a lead was introduced into the mold with the compact a kept therein, thereby joining to the compact a. Thus a compact b was formed for the lead having the shape shown in FIGS. 1 and 2.

Subsequently, a ceramic paste containing 85% by mass of silicon nitride ($Si_3N_4$) powder, 10% by mass of ytterbium oxide ($Yb_2O_3$) as a sintering agent, and 5% by mass of tungsten carbide (WC) for bringing the thermal expansion coefficient close to that of the resistor and the lead was injected into the metallic mold with the compact a and compact b kept therein. Thus, a compact d was formed in which the compact a and the compacts b were embedded in a compact c for the insulating base.

Subsequently, the resulting compact d was sintered by hot press at a temperature of 1700° C. and a pressure of 35 MPa in an atmosphere of a non-oxidizing gas containing nitrogen gas in a carbon cylindrical mold. Thus the heater of the Example of the present invention was completed. In the heater (sample of the Example of the present invention), the lead had two bent portions, and the sections of the bent portions had aspect ratios increasing in the direction toward the resistor. The section of the portion between the bent portions had aspect ratios increasing gradually in the direction from the terminal toward the resistor. Also, the sections were in an oval shape, and the sectional areas of the two bent portions were the same. The insulating base had a diameter of 3.2 mm. The bent portion closer to the terminal portion had a shorter axis of 1.1 mm in length and an aspect ratio (length of longer axis/length of shorter axis) of 1.5, while the bent portion distant from the terminal portion had a shorter axis of 0.8 mm and an aspect ratio (length of longer axis/length of shorter axis) of 3.5.

Then, a cylindrical metallic holding member was welded to the end (terminal portion) of a lead extracted from the side near the back end of the resulting heater to yield a glow plug.

On the other hand, another glow plug was prepared as the Comparative Example. This glow plug included a lead having two bent portions whose sections each had the same aspect ratio as the aspect ratio of the sections of the terminal portion and the resistor. The terminal portion, the bent portions and the resistor of this sample had oval sections of 1.2 mm in shorter length and an aspect ratio (length of longer axis/length of shorter axis) of 1.1.

The glow plugs were subjected to heat cycle test. The heat cycle test was performed under the conditions where the voltage applied to the heater was set so that the temperature of the resistor could be increased to 1400° C., and a cyclic operation including: (1) supplying power for 5 minutes; and (2) suspending power supply for 2 minutes was repeated 10 thousand times.

The variation between the resistances of the heater before and after the heat cycle test was measured. For the Example of the invention, the variation in resistance of the sample was 1% or less. In addition, there was no sign showing local heating or micro-cracks at the interface between the lead and the insulating base in the sample.

For the Comparative Example, on the other hand, the variation in resistance was 5% or more, and a micro-crack was observed.

REFERENCE SIGNS LISTS

1: heater
2: insulating base
3: resistor
31: heat-generating portion
4: lead
41, 42: bent portion
5: terminal portion

What is claimed is:

1. A heater comprising an insulating base, a resistor embedded in the insulating base, a lead embedded in the insulating base, the lead joined to the resistor at one end thereof, the other end thereof being led out as a terminal portion on a surface of the insulating base, the lead in longitudinal section having at least two bent portions, wherein the bent portions in cross-section each have an aspect ratio larger than the aspect ratio of the terminal portion.

2. The heater according to claim 1, wherein the cross sections of the bent portions have aspect ratios increasing gradually in the direction from the terminal portion toward the resistor.

3. The heater according to claim 2, wherein the aspect ratio in cross section of the lead between the bent portions increases gradually in the direction from the terminal portion toward the resistor.

4. The heater according to claim 1, wherein the bent portions each have an oval cross section.

5. The heater according to claim 1, wherein the bent portions have the same cross-sectional area.

6. A glow plug comprising the heater as set forth in claim 1, and metallic holding member electrically joined to the terminal portion and holding the heater.

* * * * *